United States Patent [19]

Paulet et al.

[11] Patent Number: 4,498,967

[45] Date of Patent: Feb. 12, 1985

[54] DEVICE FOR PRODUCING DISPERSION COATINGS

[75] Inventors: Jean-François Paulet, Siblingen; Othmar Eisenlohr, Dottikon, both of Switzerland

[73] Assignee: Swiss Aluminium Ltd., Chippis, Switzerland

[21] Appl. No.: 535,269

[22] Filed: Sep. 23, 1983

[30] Foreign Application Priority Data

Oct. 6, 1982 [CH] Switzerland ..... 5860/82

[51] Int. Cl.[3] ..... C25D 17/00; C25D 21/10

[52] U.S. Cl. ..... 204/272; 204/273

[58] Field of Search ..... 204/272, 273

[56] References Cited

U.S. PATENT DOCUMENTS 3,922,208 11/1975 Cordone ..... 204/272
4,085,010 4/1978 Ishimori ..... 204/272
4,174,261 11/1979 Pellegrino ..... 204/273

FOREIGN PATENT DOCUMENTS 753929 8/1980 U.S.S.R. ..... 204/273

*Primary Examiner*—Thomas Tufariello
*Attorney, Agent, or Firm*—Bachman and LaPointe

[57] ABSTRACT

The homogeneity of the electrolyte bath close to the surface to be coated is of great importance when depositing dispersion coatings by electrolyte co-precipitation of solid particles in suspension and at least one dissolved metal salt. Homogenous suspension electrolyte is made to flow continuously onto the surface (24) to be coated with the help of at least one feed pipe (42) which features outlets (43) directed at that surface (24) and which moves along adjacent to the said surface (24). The said feed pipe (42) is connected via a pipe (41) to a hollow axle (3) and such that these parts together form a rotor. The workpiece (2) to be coated can at the same time serve as the container for the electrolyte bath.

12 Claims, 1 Drawing Figure

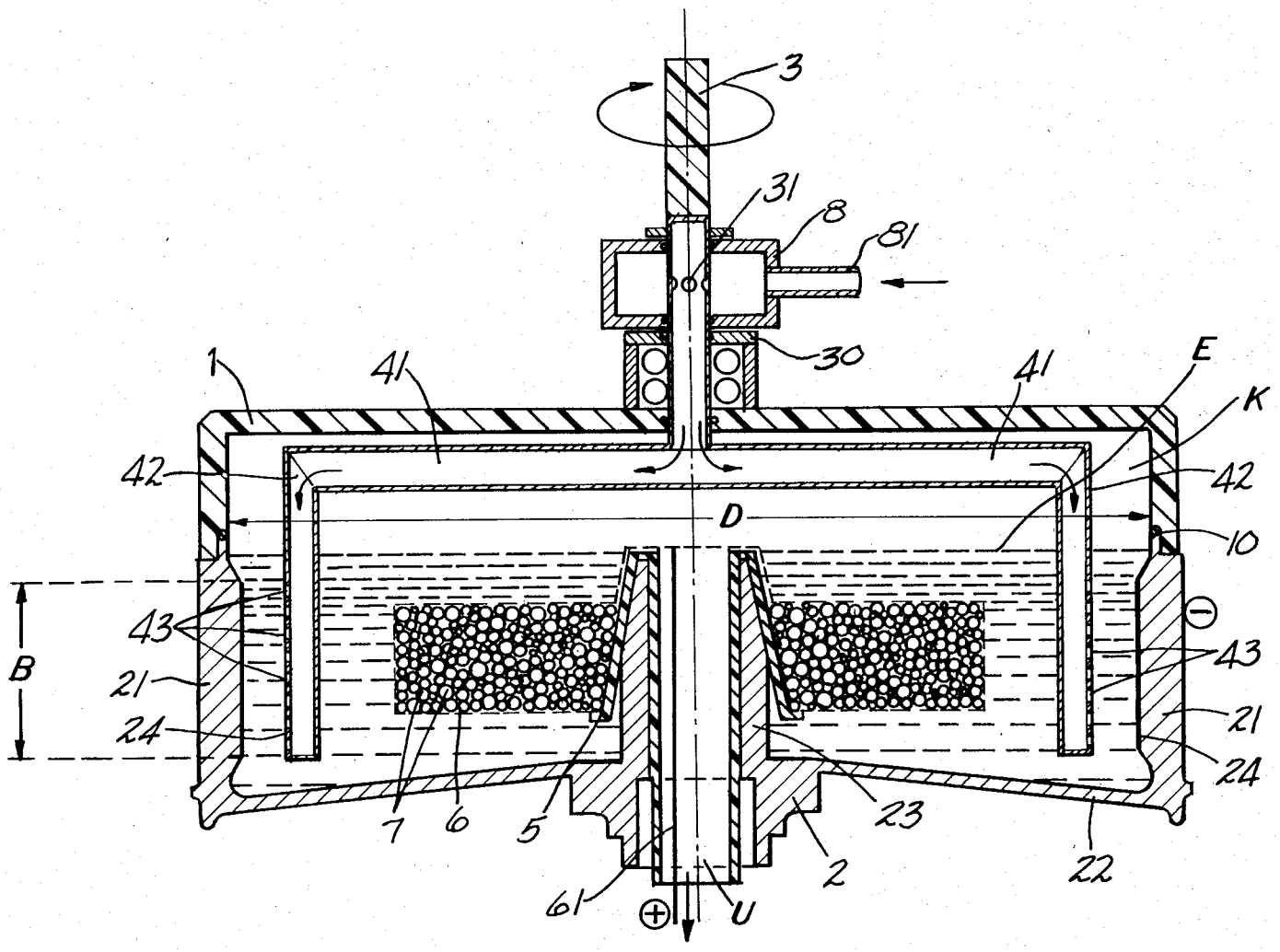
E
K
42
10
43
21
24
22
41
81
8
30
3
31
23
2
D
U
61
5
6
7
1
B

DEVICE FOR PRODUCING DISPERSION COATINGS

BACKGROUND OF THE INVENTION

The present invention relates to a process and a device for electrolytic depositon of a metal coating containing solid particles held in suspension, hereinafter called suspension electrolyte. The device required to carry out this process features a container to hold this suspension electrolyte and an anode, the workpiece to be heated being made the cathode.

The use of metals in the technical field frequently calls for an improvement in surface properties, in particular wear resistance, hardness and sliding properties and general wear resistance characteristics. Numerous applications for aluminum in automobile and machine manufacture in particular are possible only in combination with hard, wear-resistant coatings. Electrolytic deposition of a metal layer incorporating hard particles of material represents a simple and, for many wear problems, suitable possibility for improving the surface.

The dispersion coatings, in many cases the nickel/silicon carbide system is usefully employed, which result from simultaneous deposition of metal and solid particles from a suspension electrolyte exhibit many and varied properties by appropriate choice of matrix material, particle material, size and distribution.

Electrolytically deposited dispersion coatings have been known already for some decades. Equipment used to produce them are described e.g. in the journal "Schmiertechnik", 11 (1980), pp 81–86. In an earlier article in the journal "Oberflächentechnik" (1975), pp 45–52 attention is drawn to the fact that movement of the bath i.e. the electrolyte is of very great importance for the rate of incorporating the solid particles in the metal as it is deposited.

There it is suggested that the movement of the bath be achieved by injection of air, circulating the electrolyte, or with the help of stirrer. The effect of the movement of the bath is intended to insure that the solid particles along with the electrolyte reach a place above the workpiece so that the said particles can settle on the surface of the workpiece under the force of gravity and be bonded there by the metal coating.

Moving the bath by means of conventional stirrers or circulating it is not suitable as changes in the turbulence along the surface of the part to be coated results in non-uniform incorporation of solid particles into the metal of the coating. Although better results have been obtained with air injection than with the other above mentioned measures, this method is also not suitable inasmuch as it leads to inhomogeneities or differences in concentration in the suspension electrolyte, and thus also results in irregular incorporation of the dispersion in the coating.

The object of the present invention is to eliminate these disvantages.

SUMMARY OF THE INVENTION

This object is achieved by way of the invention in which the cathodically polarized workpiece surface to be coated is impinged on in the treatment bath by homogeneous suspension electrolyte fed to it by means of at least one feed pipe which features at least one outlet opening and is moved in the bath along and at a distance from the said surface.

As such the injected suspension electrolyte is taken from the bath in such a way that circulation of the suspension electrolyte constituting the bath takes place via the feed pipes with the outlet openings.

The device for carrying out this process has at least one feed pipe which features at least one outlet opening and projects into the bath, and also suitable means for moving this feed pipe or these feed pipes along and adjacent to the surface to be coated.

BRIEF DESCRIPTION OF THE DRAWING

The invention is described in greater detail in the following with the help of a preferred exemplified embodiment thereof which is shown in the drawing and concerns the coating of brake drums.

The said drawing shows a cross section through a device for electrolyte deposition of dispersion coatings.

DETAILED DESCRIPTION

For coating flat or domed surfaces the feed pipe can usefully be mounted on an alignment rail and moved back and forward along this rail.

For coating surfaces of cylindrical or conical workpieces the feed pipe or pipes can be connected by an intermediate pipe to a hollow axle through which the suspension electrolyte passes. With this arrangement only one inner or one outer surface of the cylindrical or conical workpiece can be coated.

The feed pipe is usefully arranged parallel to the surface to be heated and features at the side facing the mentioned surface outlets which can be nozzle or slit shaped.

According to a further feature of the invention the feed pipe is provided with nozzles over the whole length and breadth of the surface to be coated. The workpiece surface not to be coated is then covered over with a resistant paste.

Furthermore the distance between the feed pipe and the surface to be coated is generally, and usefully, smaller than the distance between this surface and the anode in the bath.

It has been found particularly advantageous for coating the inside faces of a hollow workpiece to employ this workpiece directly as the container for the electrolyte and, if necessary, to seal off the bottom with a base. As such, when coating cylindrical or conical workpiece surfaces, it is useful to have the anode in the form of a hollow cylinder or to use an anode basket of this shape. Such an arrangement has been found to be particularly advantageous when the inner surfaces of cylindrical automobile parts, e.g. separate brake drums or the same integrated in the wheel rim, in particular such made of aluminum or aluminum alloys, are to be coated with a nickel/silicon carbide dispersion layer. If such brake drums feature bolt holes, these can be closed off with plugs.

With such a version of the device according to the invention the workpiece surface to be coated is, with the aid of the spinning rotor, uniformly jetted with the electrolyte suspension in which the solid particles are uniformly distributed; as a result a uniform co-precipitation of the soild particles and the metal is achieved e.g. to produce the brake lining.

The distance from the feed pipe, through the nozzles in which a continuous stream of homogenized suspension electrolyte is jetted onto the surface to be coated, to that surface, and the flow rate of the jetted suspension electrolyte, must be chosen such that the stream of electrolyte emerging from the nozzles on the moving feed pipes impinges on the surface to be coated. However this must be done in such a way that the solid particles in the electrolyte, e.g. silicon carbide particles which are known to have a very abrasive action, do not damage or even to some extent remove the already deposited layer of metal.

As a result of the favorable geometry of the described device a very regular, uniformly thick coating per unit area of workpiece is achieved. The expensive mechanical finishing of the precipitated dispersion coating, such as was necessary when using devices known up to now, is reduced or even no longer required.

Referring to the drawing, a cap like cylindrical cover 1 of diameter D, if necessary with an intervening O-ring 10, on the cylindrical wall 21 of a metal brake drum 2 with base 22 and hub 23. The base 22, hub 23 and wall 21 form, when the base 22 is horizontal, a container to hold the suspension electrolyte; the opening in the hub 23 serves here as an overflow U. Positioned at the center of the cover 1 is a hollow axle 3 which is aligned by a ball type bearing 30; the said axle 3 projects into a chamber formed by the cover 1 and brake drum 2. Situated above the bearing 30 is a feeded tank 8 fitted with O-rings and with an inlet pipe 81; that part of the axle 3 inside the feeder tank 8 features holes 31. A part of the axle 3 projecting out of the feeder tank 8 is connected to a motor drive. Joined on to the hollow, tube-shaped part of the axle 3 in chamber K, and approx. perpendicular to it, are connecting pipes 41 with feed pipes 42 running parallel to the axle 3 attached at the ends; the feed pipes 42 feature nozzle openings 43 directed at the brake surface 24; components 3, 41 and 42 together form a rotor.

Fitted on to the end of the hub 23 inside the chamber K is an electrically insulating cap 5 which supports an electrically conductive, cylindrical and reticulated anode basket 6 which is connected by an electrical lead 61, the said basket 6 containing the anode metal 7 in pellet or granulate form. The brake drum 2 and the basket 6 are therefore electrically insulated from each other.

The rotor made up of the axle 3, connecting pipes 41 and feeder pipes 42 with nozzles 43 is made of a chemically resistent material which also does not conduct electricity e.g. plastic, in particular polypropylene. Although the cover 1 and the brake drum could be arranged to rotate about the axle 3, they are normally held stationary: they form therefore almost a kind of stator.

To deposit a metal coating containing solid particles electrolytically on to the brake surface 24, the chamber K is filled to the level of the inner part of the hub 23 with electrolyte containing solid particles i.e. with the suspension electrolyte. Excess electrolyte runs out the overflow U. The brakedrum is made the cathode, the basket 6 with anode metal the anode. As the rotor turns, additional suspension electrolyte, containing homogenously distributed particulate solid, is continuously fed to chamber K. This feed of suspension electrolyte takes place via the inlet pipes 81 on the feeder tank 8 from which the electrolyte flows through holes 31 to the rotor. Thereafter, the electrolyte emerges from nozzles 43 and then impinges on brake surface 24 which is to be coated. The excess electrolyte flows off through the overflow U and, though not shown in the drawing, can be returned to the inlet pipe 81 with the aid of a pump.

What is claimed is:

1. Device for producing dispersion coatings on surfaces of metallic parts by electrolyte deposition which comprises a suspension electrolyte which forms the treatment bath and which contains at least one dissolved metal salt and particulate solid which is in suspension, a cathodically polarized surface to be coated in contact with said bath, at least one feed pipe spaced from said surface and having at least one outlet opening, means to jet said surface in the bath with said suspension electrolyte via said feed pipe, and means to move said feed pipe along the workpiece surface which is to be coated spaced from said workpiece, thereby uniformly jetting said surface with said suspension electrolyte to achieve uniform co-precipitation of said particulate solid and dissolved metal.

2. Device according to claim 1 including a container for the treatment bath.

3. Device according to claim 2 wherein said container includes said surface.

4. Device according to claim 1 including an anode system with the part to be coated made the cathode.

5. Device according to claim 1 wherein the feed pipe is connected via a connecting pipe to a rotatable hollow axle such that the connecting pipe and the hollow axle serve as feed lines for supplying suspension electrolyte to the feed pipe.

6. Device according to claim 5 for coating cylindrical or conical surfaces.

7. Device according to claim 5 wherein the hollow axle passes through a bearing and a feeder tank with inlet pipe, in which region the axle features inlet openings.

8. Device according to claim 7 wherein said bearing is a ball type bearing.

9. Device according to claim 1 wherein the feed pipe features outlets along a length corresponding to the breadth (B) of the surface to be coated.

10. Device according to claim 4 wherein the distance from the feed pipe to the workpiece surface is smaller than the distance from this surface to the anode.

11. Device according to claim 2 wherein said container is formed by the workpiece whose inner surface is to be coated.

12. Device according to claim 4 wherein the anode is in the form of a hollow, cylindrical anode basket filled with anode metal.

* * * * *

UNITED STATES PATENT AND TRADEMARK OFFICE

CERTIFICATE OF CORRECTION

PATENT NO. : 4,498,967

DATED : February 12, 1985

INVENTOR(S) : Jean-Francois Paulet et al.

It is certified that error appears in the above-identified patent and that said Letters Patent are hereby corrected as shown below:

Column 2, line 62, change "soild" to --solid--.

Column 3, line 24, change "feeded" to --feeder--.

Column 4, claim 1, line 12, change "electrolyte deposition" to --electrolytic deposition--.

Signed and Sealed this

*Fifth* Day of *November 1985*

[SEAL]

*Attest:*

DONALD J. QUIGG

*Attesting Officer*

*Commissioner of Patents and Trademarks*